United States Patent [19]

Peacock

[11] Patent Number: 4,984,796

[45] Date of Patent: Jan. 15, 1991

[54] DEVICE AND METHOD FOR SELECTING RANDOM NUMBERS FOR PLAYING LOTTERY GAMES

[76] Inventor: Lawrence L. Peacock, 7510 Salem Rd., Falls Church, Va. 22043

[21] Appl. No.: 354,711

[22] Filed: May 22, 1989

[51] Int. Cl.[5] ..... A63F 5/02; A63F 3/06

[52] U.S. Cl. ..... 273/142 E; 273/269

[58] Field of Search ..... 273/138 R, 142 D, 142 E, 273/142 F, 142 G, 142 HA, 274, 142 R, 269

[56] References Cited

U.S. PATENT DOCUMENTS

| | | | |
|---|---|---|---|
| 107,882 | 10/1870 | Crozier et al. | 273/142 E |
| 1,370,682 | 3/1921 | Buys | 273/142 R |
| 1,442,651 | 1/1923 | Cory | 273/142 E |
| 1,491,961 | 4/1924 | Miller | 273/142 E |
| 1,496,721 | 6/1924 | Martin | 273/142 E |
| 1,555,848 | 10/1925 | Hunau et al. | 273/142 E |
| 1,560,496 | 11/1925 | Bakketun | 273/119 R |
| 1,580,305 | 4/1926 | Koegle | 273/93 R |
| 3,090,623 | 5/1963 | Dogan | 273/142 R |
| 3,163,426 | 12/1964 | Ruderian | 273/142 R |

FOREIGN PATENT DOCUMENTS

| | | | |
|---|---|---|---|
| 160157A | 6/1985 | European Pat. Off. | 273/142 E |
| 0546371 | 11/1922 | France | 273/142 E |
| 1113258 | 5/1968 | United Kingdom | 273/142 R |

OTHER PUBLICATIONS

"Things You Never Knew Existed", Johnson Smith Company, pp. 15 and 53.

*Primary Examiner*—Edward M. Coven
*Assistant Examiner*—W. Pierce
*Attorney, Agent, or Firm*—Sixbey, Friedman, Leedom & Ferguson

[57] ABSTRACT

A device and method for selecting a plurality of numbers for an entry in a game of chance such as a lottery game in which an entry comprises a subset of numbers chosen from a set of numbers which are selectable in the lottery game. A wheel is provided having a plurality of rest positions, each rest position having a distinct number associated therewith, the distinct numbers forming the set of numbers which are selectable in the lottery game. A plurality of balls are placed on the wheel, with the number of balls corresponding to the quantity of numbers to be selected to form the subset of numbers forming the entry. The wheel is designed to cause each ball to assume one of the rest positions such that a distinct number is selected for each ball and the entry comprises the subset of numbers selected by the plurality of balls.

1 Claim, 3 Drawing Sheets

DEVICE AND METHOD FOR SELECTING RANDOM NUMBERS FOR PLAYING LOTTERY GAMES

FIELD OF THE INVENTION

The invention relates to an improved device and method for selecting random numbers, and more particularly, for selecting an entry for playing lottery games.

BACKGROUND OF THE INVENTION

State lottery games have gained widespread acceptance and popularity in recent years. To play many of the State-run lottery games a player selects a subset of numbers to be printed on a ticket from a larger set of selectable numbers. Large sums of money are won if a player's ticket numbers correspond in whole or in part to the winning numbers. Typically a series of five to seven numbers ranging from one-forty, for example, are selected in hopes that they will match the winning numbers.

In the past players have been known to use a variety of methods for selecting numbers such as birthdates, fortune tellers, numbers contained on a newspaper page or other numbers personal to the player. When a player desires to purchase a large number of tickets, the selection of numbers becomes agonizing and time consuming.

In many states a player has the option of allowing a computer to randomly select the numbers to be printed on the ticket. However, many players are skeptical of allowing a state owned machine to pick their lottery numbers. Computer programs are available which generate random numbers for playing lottery games, however, such programs are expensive and require the user to own a personal computer.

Wheel-type game devices are well known in the prior art, however, the prior art is devoid of any wheel-type devices which are suitable for selecting a series of distinct random numbers for playing lottery games. For example, U.S. Pat. No. 1,560,496 to Bakketun discloses a wheel-type device in which one or more balls are propelled from central spinning arms toward the outer periphery of a disk to attempt to seat the balls in recesses located on the disk. Each recess has associated indicia adjacent thereto for playing various games. The Bakketun patent, however, does not disclose a wheel-type device in which a distinct numerical value is associated with each possible rest position of the balls. Thus, the Bakketun device is inadequate for selecting a series of distinct random numbers such as for selecting lottery numbers. Bakketun is further inadequate for selecting a series of random numbers in that the disk or wheel is sloped downwardly from the recesses toward the center of the disk, which may require repeated spinning before all balls are seated in a recess.

U.S. Pat. Nos. 1,496,721 to Martin and 1,491,961 to Miller also disclose wheel-type game devices having various numerical values associated with different positions on the wheels. The Martin and Miller patents also fail to disclose wheel-type devices in which a distinct numerical value is associated with each possible rest position of the ball or balls and thus are unsuitable for use in selecting a series of numbers for an entry in a lottery game.

Often a wide range of numbers are selectable for playing lottery games. The prior art wheel-type devices are further unsuitable for selecting such a wide range of numbers in that prior art wheel-type game devices do not provide a sufficient number of rest positions to accommodate the numbers selectable in a lottery game.

SUMMARY OF THE INVENTION

In view of the foregoing it is an object of the present invention to provide a wheel-type device which assists in selecting an entry for a lottery game in which the entry comprises a subset of numbers selected from a set of numbers which are selectable in the lottery game.

A further object of the invention is to provide a wheel-type device in which a lottery entry is selected by the rest positions assumed by a plurality of balls on the wheel.

Another object of the invention is to provide a wheel-type device which tends to insure that each ball of a plurality of balls assumes a separate rest position having a distinct number associated therewith. By preventing two or more balls from assuming a single position and causing each ball to assume a defined rest position, the possibility of having to repeatedly spin the device until all balls assume a distinct rest position is minimized.

Another object of the invention is to provide a wheel-type device capable of providing for a large number of rest positions. By providing a large number of rest positions, it is possible to select a plurality of numbers for an entry where the set of possible numbers is large.

Yet another object of the present invention is to provide a method for selecting an entry for a lottery game in which a plurality of balls are placed on a wheel-type device and the lottery entry is determined by the numbers associated with the rest positions assumed by the balls.

These and other objects of the present invention are achieved by providing a device for selecting a plurality of numbers for an entry in a game of chance such as a lottery game wherein the entry comprises a subset of numbers chosen from a field of numbers, the field of numbers comprising a set of numbers from which the subset of numbers are selectable in the lottery game. A wheel device having a plurality of rest positions is provided in which each rest position has a distinct number associated therewith. The distinct numbers form the set of numbers which are selectable in the lottery game. A plurality of balls, corresponding to the quantity of numbers to be selected, are placed on the wheel and agitated with respect to the wheel. The construction of the wheel causes each of the balls to assume a single rest position such that a distinct number is selected for each ball. The subset of numbers forming the lottery entry comprises the numbers selected by the plurality of balls.

The above, as well as other advantages of the present invention will become apparent from the drawings and the following description of the preferred embodiments.

BRIEF DESCRIPTION OF THE DRAWINGS

FIG. 3 shows the view along section 3—3 of FIG. 2.

DESCRIPTION OF THE PREFERRED EMBODIMENTS

Figure 1:
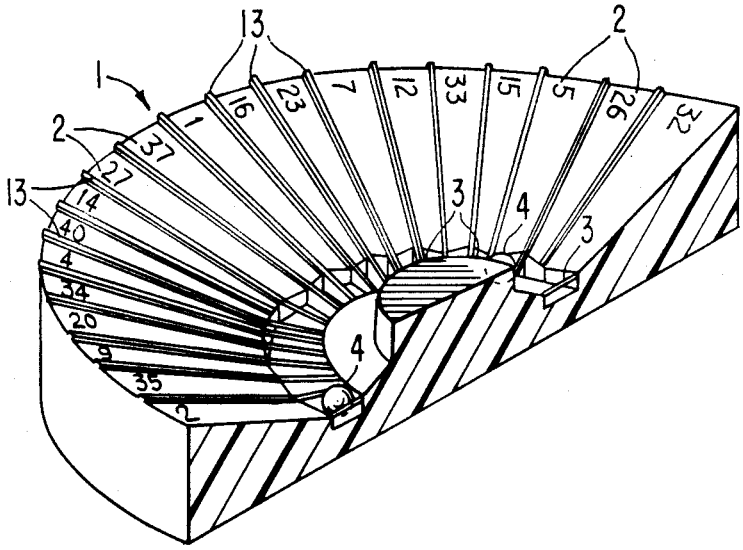
FIG. 1 is a partial perspective view of a wheel device for selecting lottery numbers in accordance with the present invention.
Figure 2:
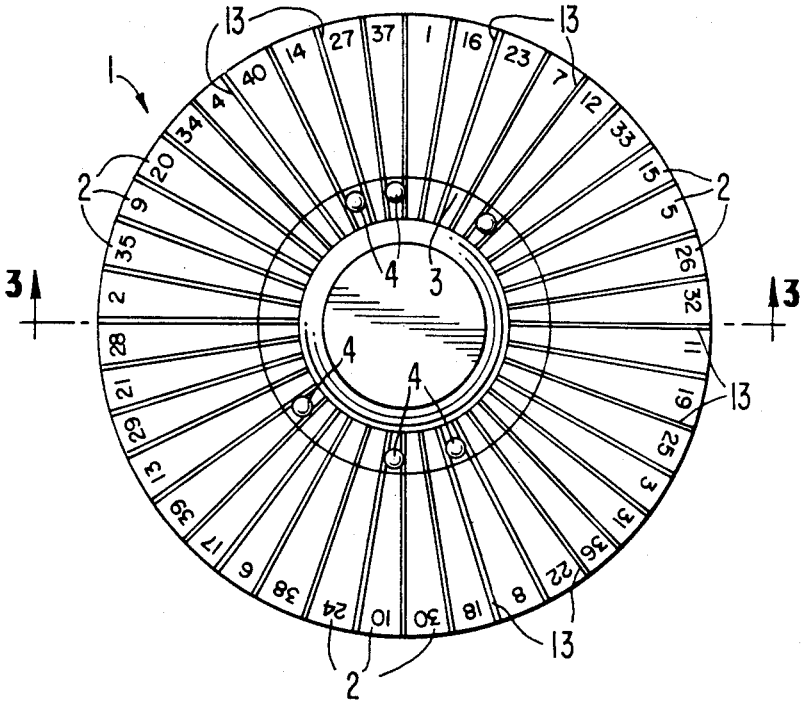
FIG. 2 is a plan view of the wheel device shown in FIG. 1.
Figure 3:
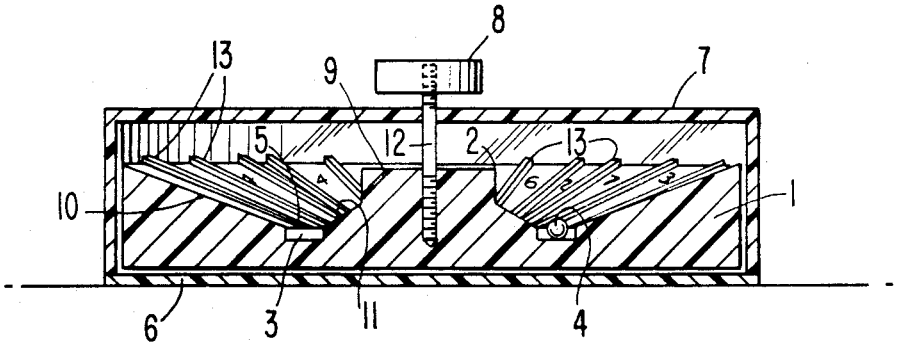
FIG. 3 is a side cross-section view of the device having a wheel as shown in FIGS. 1 and 2.

FIGS. 1–3 illustrate a wheel device in which the wheel is divided into a plurality of sectors 2. The wheel housing is omitted from FIGS. 1 and 2 for clarity. Each sector 2 has a distinct numerical value printed or painted thereon. The numbers form the set of numbers from which lottery numbers are selected. Each sector also includes a pocket 3 which defines a possible rest position for balls 4 which are placed on the wheel.

As shown in FIG. 3, the wheel includes inclined portions 10, 11 which direct the balls into the pockets 3, thereby ensuring that the balls do not come to rest outside one of the pockets. In addition, preferably the pockets are formed of a height of less than one-half the height of a ball to insure that two balls do not rest in a single pocket. The shallow pockets also avoid the possibility that a ball will be held in a rest position outside of a pocket against a ball which is at rest within a pocket. Where a ball occupies a pocket position, a subsequent ball will tend to roll about the pocketed ball and spill over into an adjacent pocket by virtue of the shallow pocket depth.

The sectors 2 are preferably divided by ribs 13. The ribs aid in agitating the balls, causing the balls to bounce around as the wheel is spun. The ribs 13 also tend to insure that each ball assumes a distinct rest position within one of the pockets, by preventing the possibility that a ball will come to rest between two adjacent pocketed balls, since it is unlikely that a ball will come to rest on top of a rib between two pocketed balls. The rib tends to cause the ball to fall on either side of the ridge and roll downwardly toward an open pocket. The pockets 3 are also defined by walls or ribs 5 which insure that a given ball comes to rest solely within a single pocket. The ribs 5, 13 may comprise a shallow wall or a wire rail. A central flat surface 9 is provided for placement of a logo or colorful design.

As shown in FIG. 3, the wheel is conveniently housed in a housing which includes a transparent plastic cover 7 and a plastic base 6. The housing prevents the collection of dust and other debris on the wheel (which can inhbit the free movement of the balls) and also prevents loss of the balls when the wheel is spun, or when the device is transported. Preferably the cover 7 is hingedly mounted or snap fitted upon the base 6 to allow for the removal or addition of balls where different quantities of numbers are to be selected. It is to be understood that the number of balls corresponds to the quantity of numbers which comprise a lottery entry. As different lottery games have different quantities of numbers which form an entry, balls are added or removed according to the particular lottery game to be played.

As also shown in FIG. 3, the wheel 1 has a spindle 12 with an enlarged circular head 8 attached thereto. The circular head 8 is rotated by hand causing rotation of the wheel. As the wheel rotates, the balls are flung out of their pocket by centrifugal force. As the rotation of the wheel stops, the balls assume new rest positions to form a lottery entry.

The manual spinning member 8 should be threadably mounted on shaft 12 so that the head 8 can be easily removed. Since various lottery games utilize different sets of numbers which are selectable, different wheels may be interchanged to allow the player to play lottery games of different states. To interchange the wheels, the spinning head 8 and cover 7 are removed and the wheel is replaced by a wheel which is suitable for the particulary lottery game to be played.

Figure 5:
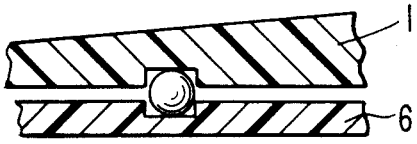
FIG. 5 is a partial section showing a ball bearing arrangement for mounting a wheel.

The wheel is preferably formed of solid plastic giving the wheel a significant weight to provide good momentum for an even, long-lasting spin. In addition, the wheel may be mounted on ball bearings as shown in FIG. 5 for smooth rotation.

Figure 4:
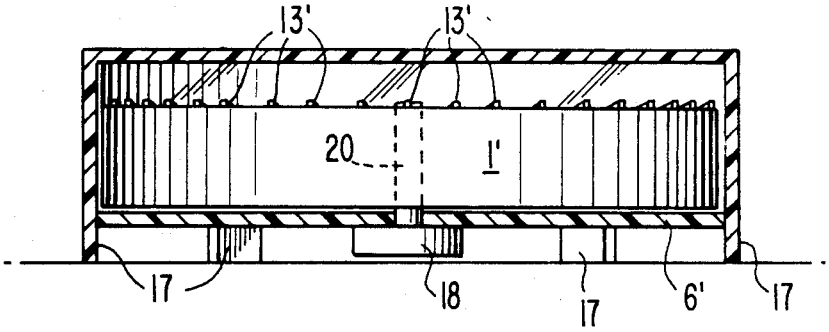
FIG. 4 is a side view of a motorized version of the wheel device for selecting lottery numbers.

It is to be understood that while the disclosed embodiment includes a manual spinning device, it is also possible to use a motor, such as a battery-powered DC motor 18 as shown in FIG. 4. In the motorized version, the DC motor is mounted at the underside of base 6', and rotates the wheel 1' via shaft 20. Legs 17 (or alternatively a depending rim) are provided to accommodate the motor at the underside of the housing. It should further be understood that the wheel device could also be fixed with respect to the housing and the player could agitate the balls simply by shaking the device and allowing the balls to assume their rest positions after the manual agitation.

Figure 6:
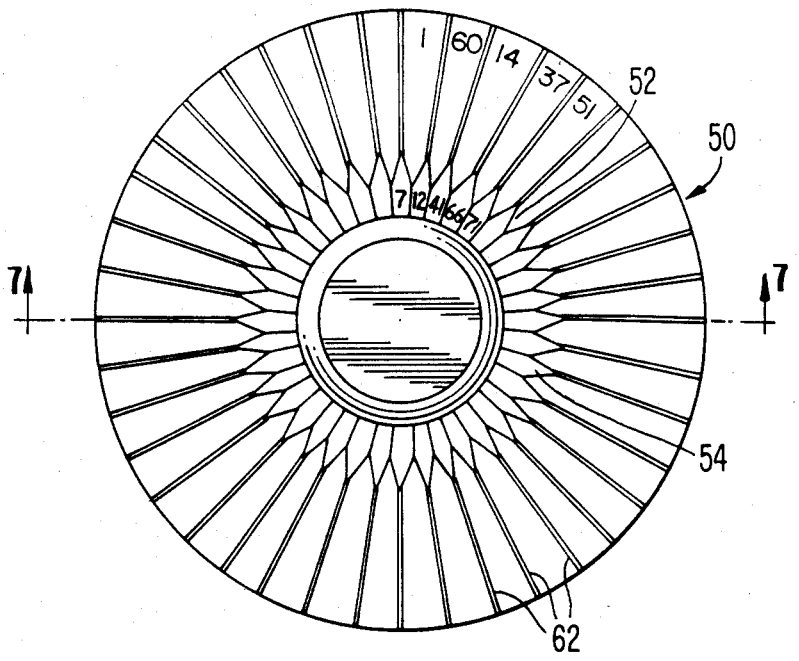
FIG. 6 is a plan view of an alternative embodiment of a wheel device for selecting lottery numbers.

FIG. 6 shows another embodiment of the wheel which is particularly suitable where the entry numbers are to be selected from a large set of numbers available in the lottery drawing. The housing and many of the selectable numbers are omitted from FIG. 6 for clarity. In the wheel 50 of FIG. 6, the pockets 52, 54 are triangular and sized such that no more than one ball will fit into a single pocket. As in the embodiment of FIGS. 1–3, ribs 62 are provided on inclined sections 60 and the pockets are shallow, of a height no more than one-half the height of the balls. Numbers are printed or painted on the wheel adjacent the base of the corresponding triangle such that numbers on the inner portion of the wheel correspond to the triangular pockets 54 having their bases facing toward the inside of the wheel and the numbers at the outer portion of the wheel correspond to the triangular pockets 52 having their bases facing toward the outer periphery of the wheel.

The intermeshed pocket arrangement allows the wheel to accommodate a large number of rest positions. This enables the wheel to be used in lottery games where the set of selectable numbers is large. In the wheel shown in FIG. 6, a total of 80 selectable numbers are possible, however, it is to be understood that the wheel can be designed to accommodate any desired number of rest positions. Since one-half of the numbers are printed on the inside of the wheel and one-half are printed on the outside, the numbers are easier to read, avoiding confusion to the player. In addition, the wheel may be colored for further ease in reading the numbers. For example, the pockets 54 and associated inner numbers may be colored white, with the pockets 52 and associated outer numbers colored black. Alternating color sections may also be used for improved visibility and appearance. The balls 4 may be colored red or other bright colors to further aid visibility.

The inclined portions 58, 60, ribs 62 and pocket ribs 63 also tend to insure that each ball comes to rest in a pocket and that no two balls assume any given rest position. Due to the height of the pocket, and the presence of the ribs, the possibility that a ball will rest between two adjacent pocketed balls is also minimized. It should be understood that other wheel designs are also possible which will prevent balls from resting outside of a pocket, as between two pocketed balls, such as pegs preventing these rest positions, or slight inclines located adjacent the pocket which prevent balls from assuming rest positions between two pocketed balls.

Figure 7:
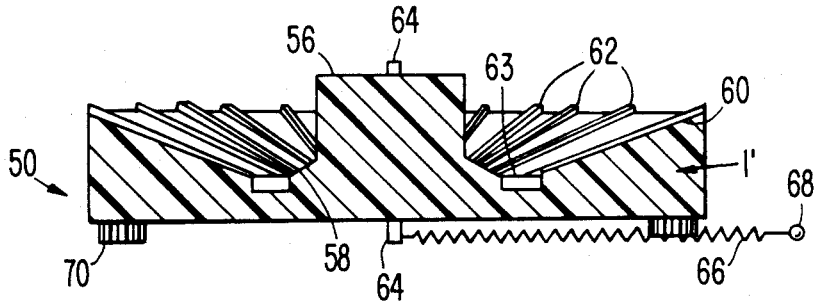
FIG. 7 is a side cross-section view (along section 7—7) of the wheel device of FIG. 6.

As shown in FIG. 7, the wheel 50 can be rotatably mounted on a shaft 64 and further may include an elastic spring 66 for spinning the wheel. Gears 70 may also be provided which will mesh with a ring gear located on the housing such that the gears will walk about a ring gear as the wheel rotates. In use, the user pulls an enlarged bead 68 placing the spring 66 under tension. When the bead 68 is released the spring will recoil about shaft 64 causing rotation of the wheel and causing gears 70 to walk about a ring gear.

A flat surface 56 is provided at the center of the wheel for placement of a logo or colorful design. The wheels described above are preferably pocket-sized, 3–4 inches in diameter, to allow the player to carry the device to the store where tickets are purchased.

OPERATION

In use, a plurality of balls corresponding to the quantity of numbers to be selected to form an entry are placed on the wheel. The wheel, having numbers corresponding to the set of numbers selectable in the lottery, is spun to agitate the balls. As the rotation of the wheel ceases, the balls assume rest positions in the pockets. The numbers associated with the rest positions of the balls form a subset of numbers which form the lottery entry.

Although the invention has been described with reference to the preferred embodiments, it will be appreicated by those skilled in the art that the invention may be practiced otherwise than as specifically described herein without departing from the spirit and the scope of the invention. It is therefore to be understood that the spirit and scope of the invention is limited only by the appended claims.

I claim:

1. A device for selecting a plurality of numbers for an entry in a game of chance such as a lottery game wherein the entry comprises a subset of numbers chosen from a field of numbers, the field of numbers comprising a set of numbers which are selectable in the lottery game, said device comprising:

a wheel having a plurality of rest positions for balls, each said rest position having a distinct number associated therewith, the distinct numbers forming the set of numbers which are selectable in a lottery game;

a plurality of balls, the number of balls corresponding to the quantity of numbers to be selected in said lottery game to form said subset;

means for causing each of said balls to assume one of said rest positions, whereby a distinct number is selected for each ball according to the number associated with the rest position of each ball and said lottery entry comprises the subset of numbers selected by said plurality of balls;

said wheel further including a plurality of pockets, said pockets defining said rest positions, and wherein said pockets are triangular, said triangular pockets each having a base wherein bases of a plurality of said triangular pockets face toward the center of the wheel and the remaining triangular pockets have bases facing toward the outer periphery of said wheel.

* * * * *